US012808209B2

(12) United States Patent
Harris et al.

(10) Patent No.: US 12,808,209 B2
(45) Date of Patent: Nov. 24, 2026

(54) SIDING GUIDE INSTALLATION VERIFICATION TOOL

(71) Applicant: Ply Gem Industries, Inc., Cary, NC (US)

(72) Inventors: Leland Harris, Cary, NC (US); Andy Breuer, Cary, NC (US); Eric Cotterman, Cary, NC (US)

(73) Assignee: Ply Gem Industries, Inc., Cary, NC (US)

( * ) Notice: Subject to any disclaimer, the term of this patent is extended or adjusted under 35 U.S.C. 154(b) by 261 days.

(21) Appl. No.: 18/816,530

(22) Filed: Aug. 27, 2024

(65) Prior Publication Data

US 2025/0243679 A1 Jul. 31, 2025

Related U.S. Application Data

(60) Provisional application No. 63/626,759, filed on Jan. 30, 2024.

(51) Int. Cl.
*E04F 21/18* (2006.01)
*E04G 21/18* (2006.01)

(52) U.S. Cl.
CPC ..... *E04F 21/1855* (2013.01); *E04F 21/1877* (2013.01); *E04G 21/1841* (2013.01)

(58) Field of Classification Search
CPC ..... E04F 21/1855; E04F 21/1877; E04G 21/1841
See application file for complete search history.

(56) References Cited

U.S. PATENT DOCUMENTS

| | | | | |
|---|---|---|---|---|
| 7,748,187 | B2 * | 7/2010 | Sensenig | E04F 15/02 52/800.1 |
| 9,200,456 | B2 * | 12/2015 | Murphy | E04F 13/0801 |
| 10,774,547 | B2 * | 9/2020 | Colyn | E04F 21/1855 |
| D1,095,193 | S * | 9/2025 | Harris | D10/69 |
| 2008/0034703 | A1 * | 2/2008 | Sensenig | E04B 5/12 52/712 |
| 2014/0013696 | A1 * | 1/2014 | Murphy | E04F 13/0869 52/489.1 |
| 2016/0060883 | A1 * | 3/2016 | Fetterman | E04F 21/1855 33/613 |
| 2019/0203483 | A1 * | 7/2019 | Colyn | E04F 13/0864 |
| 2025/0243677 | A1 * | 7/2025 | Harris | E04F 21/1855 |
| 2025/0243679 | A1 * | 7/2025 | Harris | E04F 21/1855 |

* cited by examiner

*Primary Examiner* — Yaritza Guadalupe-Mccall
(74) *Attorney, Agent, or Firm* — Duane Morris LLP

(57) ABSTRACT

A verification tool for guiding the installation of vinyl siding to a wall of a structure. The verification tool includes a face plate with a front face, a rear face, a plurality of edges and a wall extending outwardly from each edge of the face plate. The verification tool also includes an opening in the face plate proximate a top edge of the face plate and a securement through hole in each of two oppositely disposed vertically oriented walls. The verification tool includes two downwardly extending legs and a gauge for confirming the nail shank diameter used for securing the vinyl siding nail hem to the wall. The verification tool also includes a pair of legs each with a foot portion with each foot comprising a different height for use in establishing a minimum gap between a vinyl siding surface and an accessory.

19 Claims, 7 Drawing Sheets

SIDING GUIDE INSTALLATION VERIFICATION TOOL

RELATED APPLICATIONS

This application claims priority from U.S. Provisional Application No. 63/626,759 filed Jan. 30, 2024. The content of this application is incorporated herein by reference in its entirety.

TECHNICAL FIELD

This disclosure relates generally to a tool for verifying the proper installation of siding panels to a structure.

BACKGROUND

The global vinyl siding market was roughly $6.7 billion in 2022 and is forecast to surpass $10.3 Billion by 2032, growing at a CAGR of 4.4% from 2022 to 2032. The United States Vinyl Siding market size is estimated to be worth $2.2 billion in 2022 and is forecast to a readjusted size of $3.1 billion by 2028 with a CAGR of 5.68%.

Vinyl siding is a popular choice for cladding on residential and commercial buildings due to its numerous benefits relative to other types of cladding materials. Vinyl siding is known for its exceptional durability. It can withstand various weather conditions, including rain, snow, and extreme temperatures. Unlike wood, which can rot and warp, and metal, which can rust, vinyl is resistant to these issues. Its color doesn't fade as quickly as some other materials, and it's less prone to chipping or cracking. This longevity can result in cost savings over time, as homeowners won't need to replace or repaint their siding as frequently.

Vinyl siding is virtually maintenance-free. Unlike wood, it does not require painting or staining, which can save homeowners time and money. A simple wash with a garden hose or a power washer can remove dirt and grime, making it easy to maintain its appearance. This low-maintenance characteristic makes vinyl an attractive choice for those looking for a hassle-free cladding solution.

Vinyl siding comes in a wide range of colors, textures, and styles, providing homeowners with the freedom to choose a look that suits their aesthetic preferences. Whether you prefer the appearance of wood, brick, or stone, vinyl siding can mimic these looks effectively. This versatility allows for creativity in design while maintaining the benefits of vinyl.

Vinyl siding is often more affordable upfront compared to materials like wood or fiber cement. Its easy installation process further reduces labor costs. While premium options may be costlier, vinyl siding offers an excellent balance between quality and affordability. Many vinyl siding products are designed with insulation built into the panels or can accommodate additional insulation materials. This added insulation can enhance a building's energy efficiency, helping to reduce heating and cooling costs. Improved insulation also contributes to a more comfortable indoor environment by regulating temperature and reducing drafts.

Vinyl siding is recyclable, and many manufacturers incorporate recycled materials into their products. Additionally, its low maintenance requirements mean fewer resources are needed for upkeep and painting, reducing the environmental impact over time. Unlike wood siding, which can attract insects like termites and carpenter ants, vinyl siding is pest resistant. It doesn't provide a food source for these destructive pests, making it a more durable and reliable choice.

Vinyl siding is designed to be fire-resistant and can help protect your home or building in case of a fire. This feature adds an extra layer of safety to the structure, which can be especially valuable in wildfire-prone areas. Most vinyl siding manufacturers offer substantial warranties on their products, ranging from 20 to 40 years or more. These warranties provide peace of mind to homeowners, knowing that their investment is protected.

Vinyl siding offers a wide range of benefits relative to other cladding materials. Its durability, low maintenance requirements, versatility, cost-effectiveness, and energy efficiency make it a compelling choice for many property owners. Whether you're seeking an attractive and cost-effective solution for your home or a durable, easy-to-maintain cladding for a commercial building, vinyl siding provides a reliable and stylish option. Its eco-friendly features, pest and fire resistance, and extensive warranty options further enhance its appeal in the world of exterior cladding.

The installation of vinyl siding can offer numerous benefits, but it is essential to be aware of potential problems that can occur during and after the installation process. Some common issues associated with vinyl siding installation include the risk of poor workmanship. If the siding is not installed correctly, it can lead to various issues such as buckling, warping, and uneven seams. This can compromise the appearance and functionality of the siding, and repairs may be needed. Proper fastening is crucial to the stability of vinyl siding. If installers use the wrong type of fasteners, overdrive nails, or fail to space them correctly, the siding can become loose or start to pull away from the structure. This can result in unsightly gaps and may allow moisture to infiltrate, potentially causing structural damage or mold growth.

Proper insulation is essential when installing vinyl siding is also critical. Without adequate insulation, the siding may not lie flat against the wall, leading to visible waves and distortion in the siding's appearance. Moreover, poor insulation can reduce the energy efficiency of the building, resulting in higher heating and cooling costs.

Proper ventilation is necessary to prevent moisture buildup behind the siding. Without adequate ventilation, condensation can accumulate, leading to water damage and mold growth. It's important to ensure that installers correctly address ventilation needs during the installation process. Vinyl siding must also be installed with proper clearances from other elements of the building, such as roofs, decks, and the ground. If these clearances are not maintained, it can lead to problems like trapped moisture, rot, and damage to the siding or the adjacent structures.

Flashing is a crucial component of any siding installation to prevent water infiltration. If installers neglect to install or correctly integrate flashing, water can seep behind the siding and cause damage to the underlying structure. This oversight can lead to costly repairs and even structural issues over time. Vinyl siding expands and contracts with temperature changes. If installers do not provide the proper expansion gaps between panels, it can lead to warping, buckling, and cracking as the material expands and contracts. This can compromise the siding's appearance and functionality.

When vinyl siding is installed near appliances like HVAC units or gas meters, it is essential to leave sufficient clearances to ensure proper ventilation and servicing access. Failure to do so can result in obstructed airflow, inefficient appliance operation, and safety concerns. Sometimes, during vinyl siding installation, underlying structural problems, such as rot or water damage, can be discovered. These issues must be addressed before the siding is installed, as neglecting them can result in further damage and expensive repairs.

In conclusion, while vinyl siding offers many benefits, the potential problems associated with its installation are important to consider. To avoid these issues, it's crucial to hire experienced and reputable contractors who follow industry best practices. Regular maintenance, proper insulation, ventilation, and clearances are also key to ensuring that vinyl siding remains an attractive and functional cladding option for your building. Being aware of these potential problems and addressing them proactively can help ensure the long-term success of the vinyl siding installation.

SUMMARY

The disclosed verification tool addresses many of the problems existing in the vinyl siding installation industry. The disclosed verification tool includes a face plate with a front face, a rear face, a plurality of edges and a wall extending outwardly from each edge of the face plate and oppositely disposed flanges extending outwardly from at least two of the walls. In addition, the verification tool includes a through hole in the face plate proximate a top edge of the face plate.

The verification tool as disclosed herein also includes a securement through hole in each of two oppositely disposed vertically oriented walls for passing a measuring cable therethrough. Also included on this tool are at least two downwardly extending legs with an upper area and lower portion, wherein the upper area comprises a through hole gauge for confirming the correct gauge of nail for securing a vinyl siding nail hem to the wall and at least one through hole in each downwardly extending leg. The lower portion comprises a foot at the distal end of each downwardly extending leg, each foot being of a different height for use in establishing a minimum gap between a vinyl siding surface and an accessory such as a gable vent, an electrical outlet, or siding corners.

Various objects, features, aspects, and advantages of the disclosed subject matter will become more apparent from the following detailed description of preferred embodiments, along with the accompanying drawings in which like numerals represent like components. The contents of this summary section are provided only as a simplified introduction to the disclosure and are not intended to be used to limit the scope of the appended claims.

DETAILED DESCRIPTION

The following description is of various exemplary embodiments only, and is not intended to limit the scope, applicability, or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
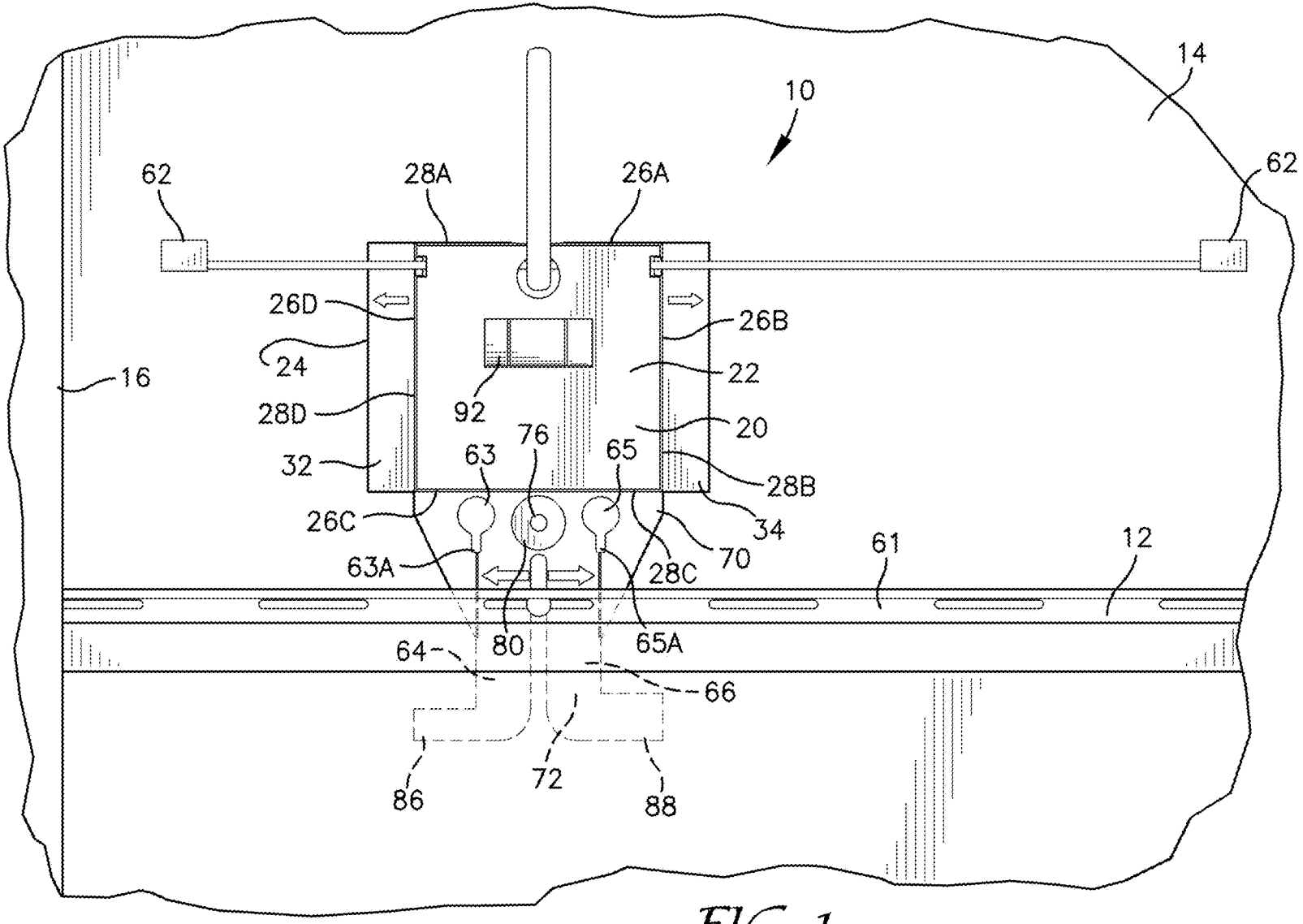
FIG. 1 illustrates a front elevation view of an embodiment of the verification tool.

FIG. 1 illustrates an exemplary verification tool 10 for guiding the installation of vinyl siding panels 12 to a wall 14 of a structure 16. The verification tool 10 includes a face plate 20 with a front face 22, a rear face 24, a plurality of edges 26A-D and walls 28A-D extending outwardly from each edge of the face plate and oppositely disposed flanges 32, 34 extending outwardly from at least two of the walls 28B, 28D.

Figure 2:
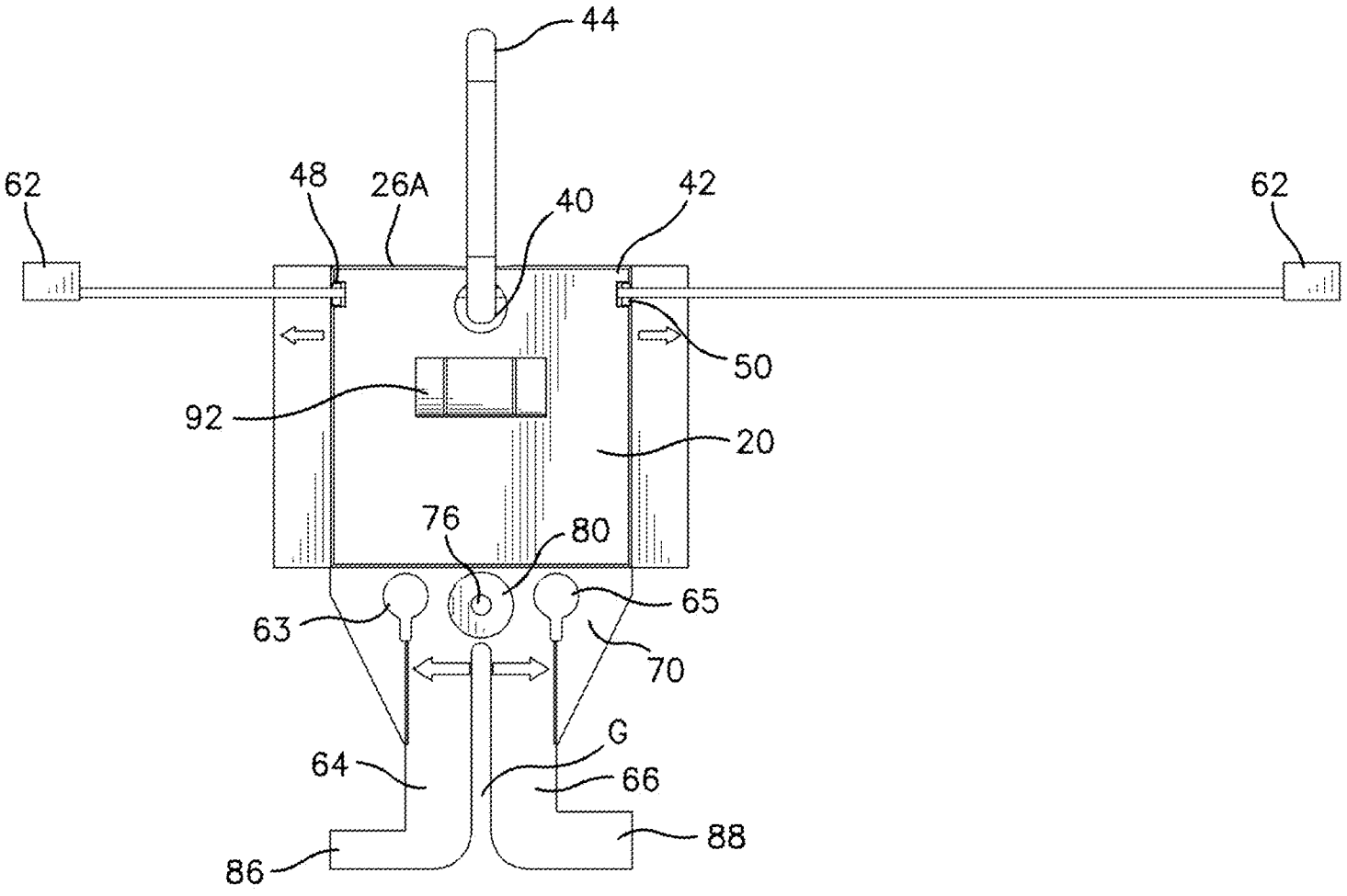
FIG. 2 illustrates a front elevation view of an embodiment of the verification tool with carabiner and measuring cable installed.

As best illustrated at FIG. 2, the verification tool 10 also includes a through hole 40 in the front face 22 of the face plate 20 proximate a top edge 26A of the face plate 20. This through hole 40 is sized for receiving a detachable carabiner 44 that is used for attachment to the belt or a belt loop of an installer when the verification tool 10 is not in use (non-operational mode) for installation purposes.

Figure 3:
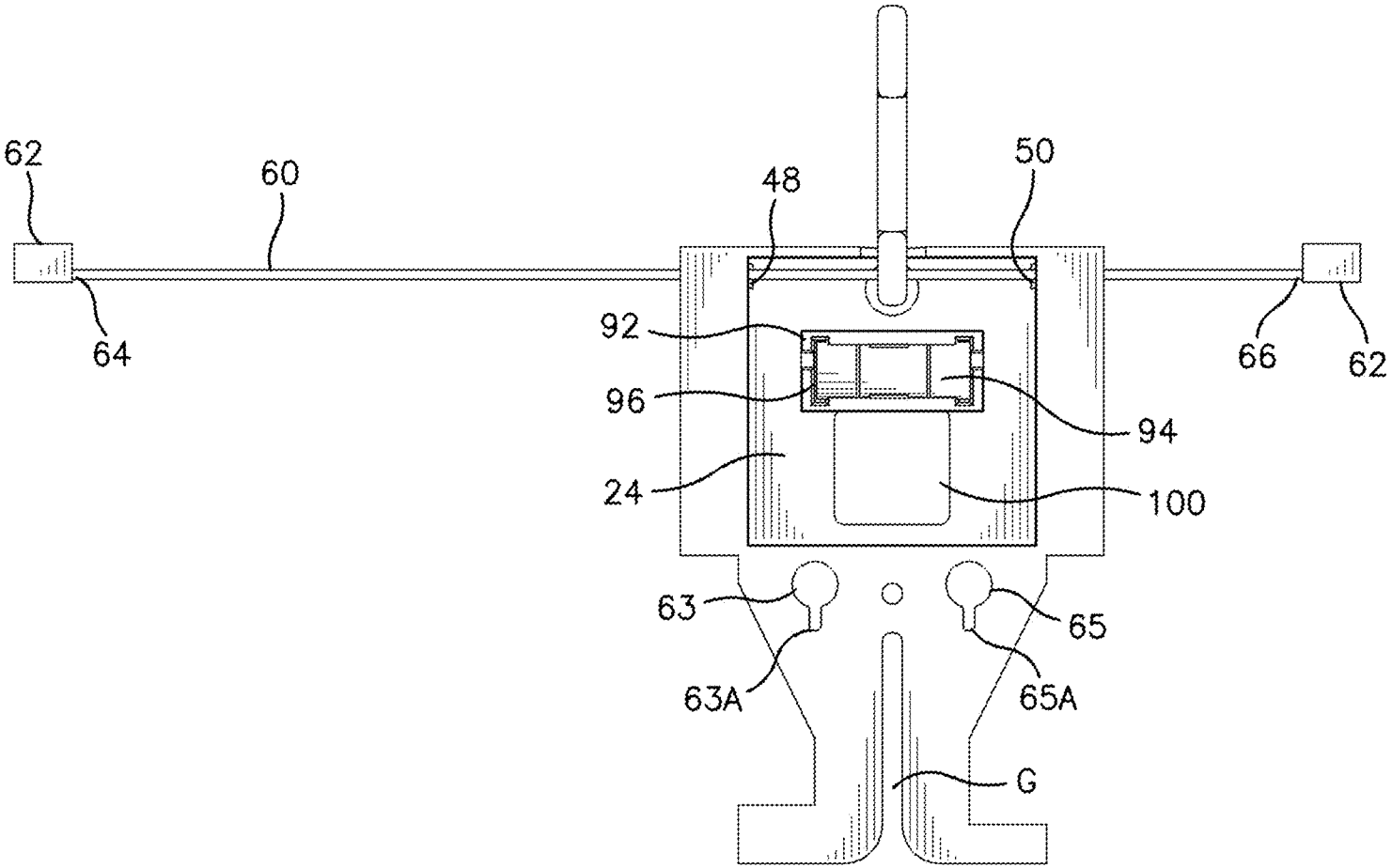
FIG. 3 illustrates a rear elevation view of an embodiment of the verification tool with carabiner and measuring cable installed.
Figure 3A:
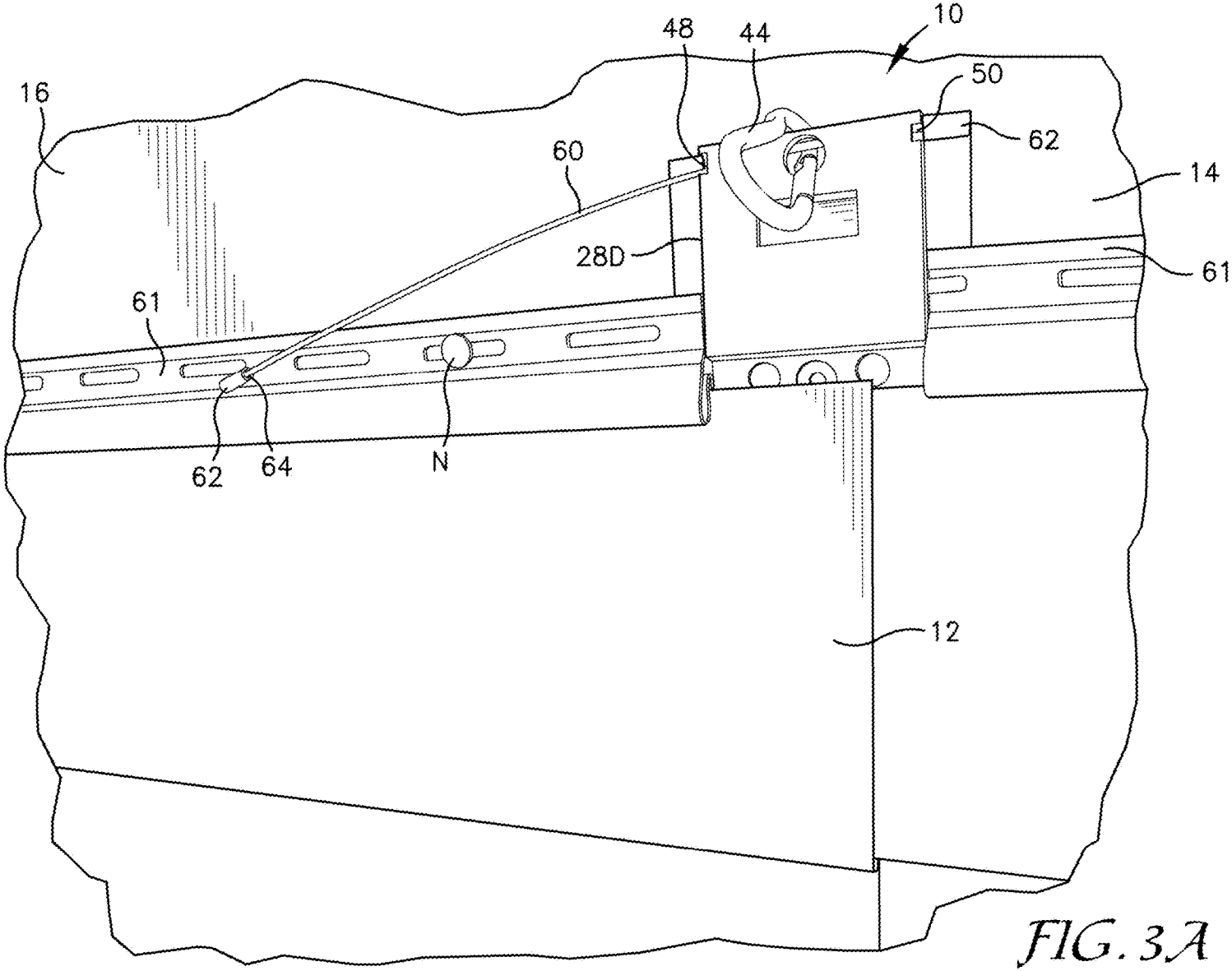
FIG. 3A illustrates the placement of an embodiment of the verification tool at the end of a siding panel nail hem and utilization of the cable to determine the proper placement a nail through the nail hem.
Figure 4:
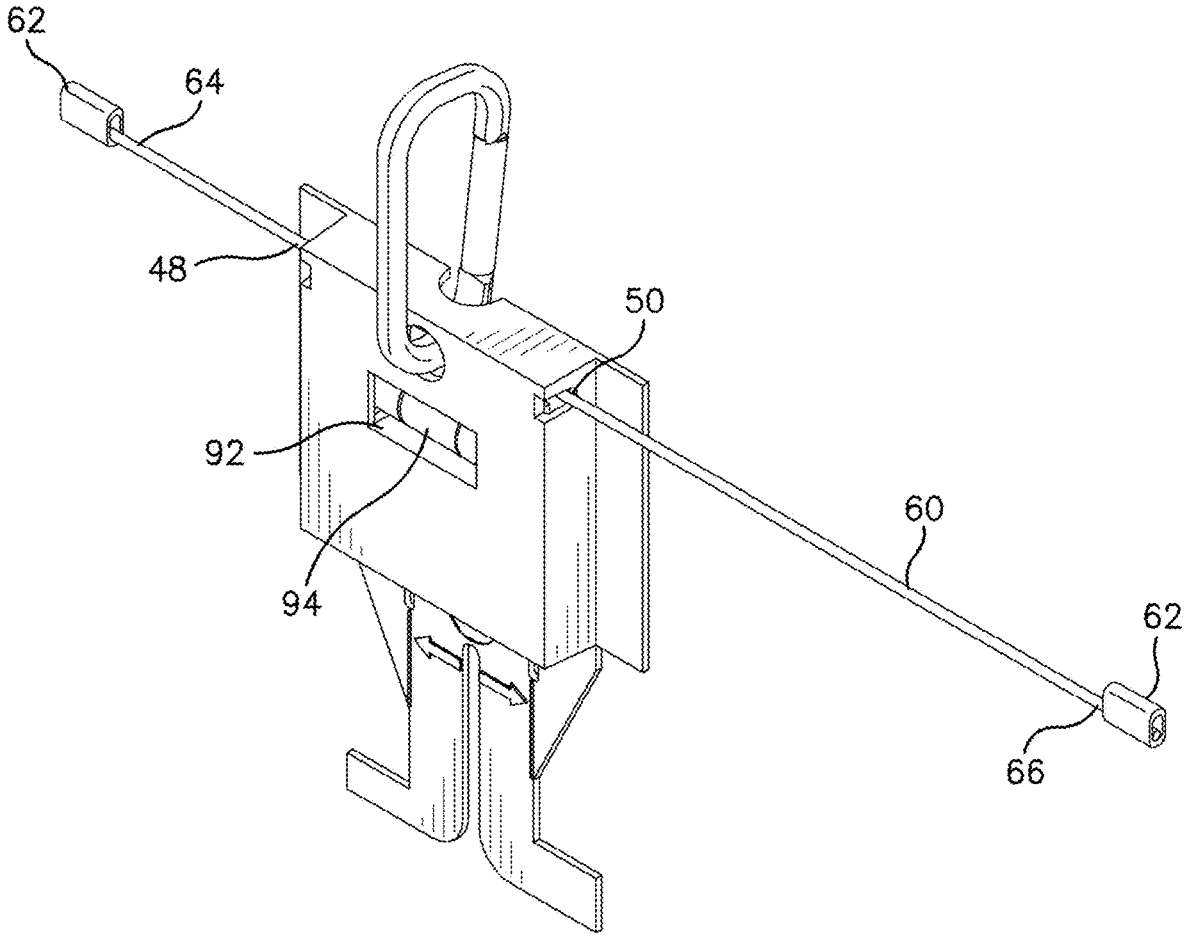
FIG. 4 illustrates a perspective view of an embodiment of a verification tool with a carabiner and a measuring cable installed.

As illustrated at FIGS. 3 and 3A, the verification tool 10 also includes restraining through holes, (optionally slots) 48, 50 in each of the two oppositely disposed vertically oriented walls 28B, 28D. These through holes are for passing through a flexible cable 60 that is used to confirm that the nail N passed through the nail hem 61 of the vinyl siding panel 12 is at a distance no greater than about 6 inches from the end edge of the vinyl siding panel 12 as the cable is installed to extend only about 6 inches from the wall 28D. The cable 60 is preferably wire rope and preferably extends in total in the range of about 8.5 to 9.0 inches. The cable 60 also preferably includes a cable crimp 62 applied to the first and second ends 64, 66 of the cable 60 to prevent withdrawal of the cable 60 from the through holes 48, 50. As best understood by viewing FIG. 1, when in a non-verification (non-operational) mode, i.e., hooked to the belt loop of an installer, the cable crimps 62 are passed through the capture holes 63, 65 and narrow capture slots 63A, 65A hold the cable 60 proximate the crimps 62 in position so that the cable 60 does not unwind out of the holes 63, 65. The capture holes 63, 65 and capture slots 63A, 65A prevent the unwieldy thrashing about of the cable 60 and crimps 62 that could be distracting to an installer during the vinyl siding installation process.

As best illustrated at FIGS. 1 and 2, the verification tool 10 also includes at least two downwardly extending legs 64, 66 with an upper area 70 and lower area 72. The upper area 70, also where the capture through holes 63, 65 are positioned, includes a through hole 76 that is surrounded by a slightly depressed area 80. The through hole 76 and depressed area 80 facilitate the sizing of the correct gauge of siding nail N to be used in securing the nail hem 61 of the vinyl siding panel 12 to the wall 14 of the structure 16. The nail N (shown at FIG. 3A) must be of the proper gauge meaning that the shank must be of a certain diameter to fit into the through hole 76 and the width of the head of the nail N must be consistent with the width of the slightly depressed area 80.

The lower area 72 includes a foot at the distal end of each downwardly extending leg 64, 66, each foot comprising a different height for use in establishing a minimum gap between a vinyl siding surface and an accessory such as gable vents, electrical outlets, and siding corners. A first foot 86 has a height of one-quarter (¼) inch and the second foot 88 has a height of three-eights (⅜) inch. The first foot 86 height is utilized when installing paneling 12 and the temperature is below 40° F. The second foot 88 establishes the preferred gap (⅜ inch) between the end edge of the panel 12 and the accessory, to accommodate for thermal expansion of the panel as ambient temperatures increase. In contrast, the first foot 86 is used to establish the preferred gap of ¼-inch between the end edge of the panel and the accessory when the ambient temperature is above 40° F. during the installation process. A small gap G separates the downwardly extending legs 64, 66 and the first and second foot 86, 88.

As illustrated at FIG. 2, the verification tool 10 also incorporates a cutout 92 in the face plate 20. As illustrated at FIG. 3, the verification tool includes a level 94 that is housed in a compartment 96 extending rearwardly from the rear face 24 of the face plate 20 at the cutout 92. The level 94 may be viewed by the siding panel installer through the cutout 92. This feature allows the siding panel installer to confirm that the siding panels 12 are in-fact being installed against the wall 14 of the structure 16 in a level orientation.

Another critical attribute of the verification tool 10 is the gauging aspect of the downwardly extending legs 64, 66 and the first and second feet 86, 88. When a siding panel 12 is being secured to the wall 14 of the structure 16 it is secured by passing a nail N through the nail hem 61, as illustrated at FIG. 3A. It is critically important that the nail N being passed through the nail hem 61 not be driven into the wall 14 to such an extent that the head of the nail N contacts the nail hem 61 and prevents lateral movement of the nail hem. The nail hem 61, and by logical extension the vinyl siding panel 12, must be able to horizontally traverse in both directions on the nails passed through the hem 61. This horizontal traverse allows the siding panel 12 to expand and contract as ambient temperatures fluctuate both diurnally and seasonally.

Figure 5:
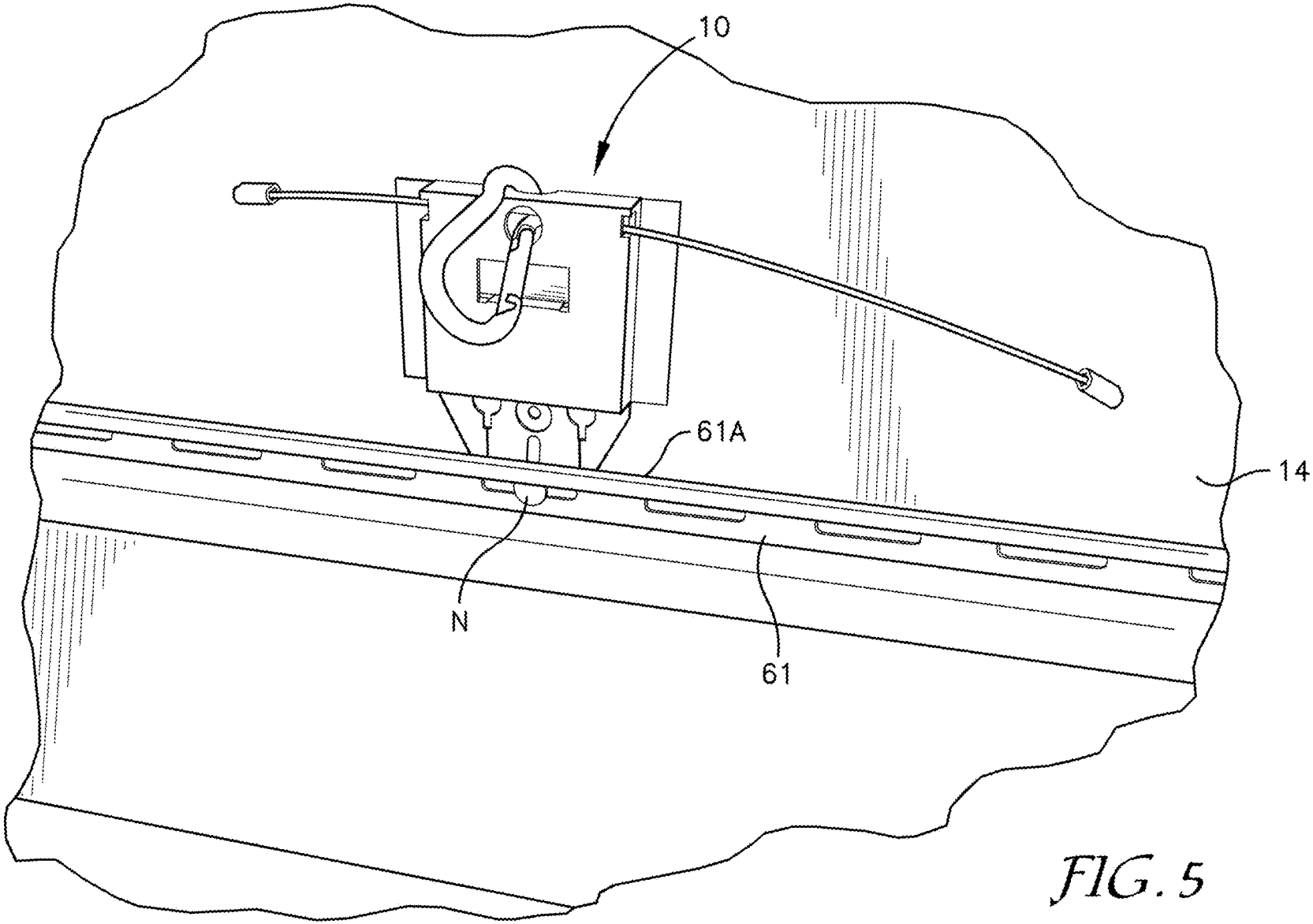
FIG. 5 illustrates the legs and feet of an embodiment of the verification tool in operation for verification of proper spacing between the rear surface of the nail hem and the surface of the structure.
Figure 6:
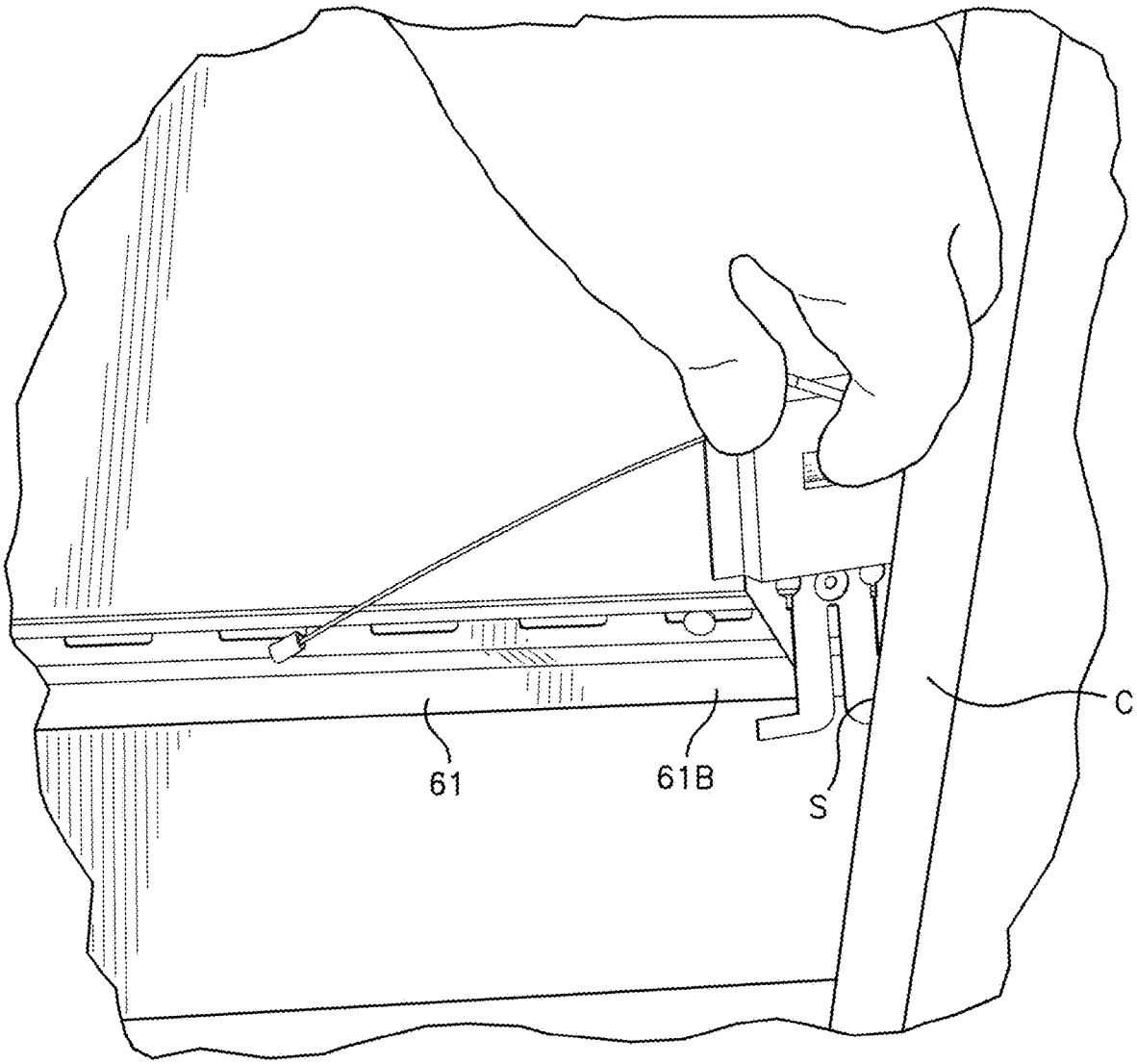
FIG. 6 illustrates the legs and feet of an embodiment of the verification tool in operation for verification of proper spacing between the front surface of the nail hem and the inner surface of a vertically extending siding corner.

The legs 64, 66 and feet 86, 88 of the verification tool 10 are fabricated with a thickness in the range of 0.04 to 0.05 inches and preferably are 0.045 inches thick. As best illustrated at FIG. 5, the gap between the rear surface 61A of the nail hem 61 and the wall 14 must provide sufficient clearance to allow entry of the legs 64, 66 and the feet 86, 88 of the verification tool 10. If the legs and feet of the verification tool 10 are unable to pass between the rear surface 61A of the nail hem 61 and wall 14, evidencing a gap of approximately 0.045 inches, the nail N securing the nail hem 61 to the wall 14 must be retracted such that there is sufficient clearance to allow the legs 64, 66 and feet 86, 88 of the verification tool to pass therebetween. Failing to perform this step may result in a nail hem 61 that is secured too tightly to the wall 14 which could eliminate the capacity of the nail hem to traverse upon the nails as the vinyl siding panel 12 expands and contracts due to ambient temperature changes. FIG. 6 illustrates the manual placement of one of the feet 88 between the front face 61B of the nail hem 61 and an interior surface S of a vertically extending siding corner C.

The verification tool 10 also preferably includes a QR code 100 that is applied to the rear face 24 of the face plate 20. The installer of the vinyl siding panels 12 can use their mobile device to scan the QR code 100 and be directed to a video providing instruction on the proper use of the verification tool 10.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

The disclosed clamp should not be construed as limiting in any way. Instead, the present disclosure is directed toward all novel and nonobvious features and aspects of the various disclosed embodiments, alone and in various combinations and sub-combinations with one another. The disclosed clamp is not limited to any specific aspect or feature or combination thereof, nor do the disclosed embodiments require that any one or more specific advantages be present, or problems be solved.

In view of the many possible embodiments to which the principles of the disclosed invention may be applied, it should be recognized that the illustrated embodiments are only examples of the disclosure and should not be taken as limiting the scope of the invention. Rather, the scope of the invention is defined by the following claims. We therefore claim as our invention all that comes within the scope of these claims.

The disclosure presented herein is believed to encompass at least one distinct invention with independent utility. While the at least one invention has been disclosed in exemplary forms, the specific embodiments thereof as described and illustrated herein are not to be considered in a limiting sense, as numerous variations are possible. Equivalent changes, modifications, and variations of the variety of embodiments, materials, compositions, and methods may be made within the scope of the present disclosure, achieving substantially similar results. The subject matter of the at least one invention includes all novel and non-obvious combinations and sub-combinations of the various elements, features, functions and/or properties disclosed herein and their equivalents.

Benefits, other advantages, and solutions to problems have been described herein regarding specific embodiments. However, the benefits, advantages, solutions to problems, and any element or combination of elements that may cause any benefits, advantage, or solution to occur or become more pronounced are not to be considered as critical, required, or essential features or elements of any or all the claims of at least one invention.

Many changes and modifications within the scope of the instant disclosure may be made without departing from the spirit thereof, and the one or more inventions described herein include all such modifications. Corresponding structures, materials, acts, and equivalents of all elements in the claims are intended to include any structure, material, or acts for performing the functions in combination with other claim elements as specifically recited. The scope of the one or more inventions should be determined by the appended claims and their legal equivalents, rather than by the examples set forth herein.

Benefits, other advantages, and solutions to problems have been described herein regarding specific embodiments. Furthermore, the connecting lines, if any, shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching may be used throughout the figures to denote different parts but not necessarily to denote the same or different materials.

In the detailed description herein, references to "one embodiment," "an embodiment," "an example embodiment," etc., indicate that the embodiment described may include a feature, structure, or characteristic, but every embodiment may not necessarily include the feature, structure, or characteristic. Moreover, such phrases are not necessarily referring to the same embodiment. Further, when a feature, structure, or characteristic is described relating to an embodiment, it is submitted that it is within the knowledge of one skilled in the art to affect such feature, structure, or characteristic relating to other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention has been described above with reference to one or more preferred embodiments, it will be appreciated that various changes or modifications may be made without departing from the scope of the invention as defined in the appended claims.

We claim:

1. A verification tool for guiding the installation of vinyl siding to a wall of a structure, the verification tool comprising:

a face plate comprising a front face, a rear face, an upper edge, a lower edge, oppositely disposed side edges, a wall extending outwardly from each edge of the face plate and flanges extending outwardly from the oppositely disposed side edges;

a through hole disposed proximate a top edge of the face plate; and first and second downwardly extending legs, the first and second legs each comprising an upper area and lower area, wherein the upper area comprises a through hole gauge for confirming the correct gauge of nail for securing a vinyl siding nail hem to the wall and at least one capture through hole in each downwardly extending leg, wherein the lower portion comprises a foot at the distal end of each downwardly extending leg.

2. The verification tool of claim 1, wherein a flexible cable with a first end and a second end is threaded through a restraining through hole in each of two oppositely disposed side walls, the flexible cable restrained from release by cable crimps on the first and second cable ends.

3. The verification tool of claim 2, wherein each of the restraining through holes are of approximately the diameter of the cable for further restraining the ends of the cables against release from the restraining through holes.

4. The verification tool of claim 2, wherein the length of the cable is in the range of 8.5 to 9.0 inches.

5. The verification tool of claim 2, wherein the cable in cooperation with the verification tool is operable to guide placement of at least one nail into the vinyl siding nail hem at no greater than 6 inches from an edge of a panel of the vinyl siding.

6. The verification tool of claim 1, wherein a cutout is disposed in the face plate of the verification tool.

7. The verification tool of claim 6, wherein a level is securely positioned within the cutout and the level is observable by a siding panel installer from the front face of the face plate.

8. The verification tool of claim 1, wherein a carabiner is detachably secured to the verification tool by passing the carabiner into the through hole in the face plate proximate the top edge of the face plate.

9. The verification tool of claim 8, wherein when in a non-operational mode the verification tool may be secured to a belt or belt loop of an installer by the carabiner.

10. The verification tool of claim 1, wherein the downwardly extending legs are in the range of 0.04 to 0.05 inches thick.

11. The verification tool of claim 1, wherein a QR code is applied to the rear face of the face plate.

12. The verification tool of claim 11, wherein upon scanning the QR code with a mobile device a training video is displayed.

13. The verification tool of claim 1, wherein an accessory comprises at least one of gable vents, electrical outlets, and siding corners.

14. The verification tool of claim 1, wherein the verification tool is fabricated from an engineered plastic.

15. The verification tool of claim 1, wherein the span of the verification tool from a base of a foot to the upper edge is about 4 inches.

16. The verification tool of claim 1, wherein a depression in the upper area surrounds the through hole for confirming the correct gauge of a nail, the depression operable for confirming the correct diameter of a head for the nail used for securing the vinyl siding nail hem to the wall.

17. The verification tool of claim 1, wherein each foot comprises a different height for use in establishing a minimum gap between a vinyl siding surface or edge and an accessory.

18. A verification tool for guiding the installation of vinyl siding to a wall of a structure, the verification tool comprising:

a face plate comprising a front face, a rear face, an upper edge, a lower edge, oppositely disposed side edges, a wall extending outwardly from each edge of the face plate and flanges extending outwardly from the oppositely disposed side edges;

an opening disposed proximate a top edge of the face plate;

a level secured within the opening; and at least one downwardly extending leg of a thickness in the range of 0.04 to 0.05 inches.

19. A verification tool for guiding the installation of vinyl siding to a wall of a structure, the verification tool comprising:

a face plate comprising a front face, a rear face, an upper edge, a lower edge, oppositely disposed side edges, a wall extending outwardly from each edge of the face plate and flanges extending outwardly from the oppositely disposed side edges;

a retention opening in each of two oppositely disposed walls;

a cable spanning across the rear face and threaded through the retention opening in each of the two oppositely disposed walls, the cable comprising a first end and a second end;

a crimp applied to the cable at both the first end and the second end to prevent passage of either crimp through the retention openings;

an opening disposed proximate a top edge of the face plate;

a level secured within the opening; and at least one downwardly extending leg.

* * * * *